US006959509B2

(12) United States Patent
Vais

(10) Patent No.: US 6,959,509 B2
(45) Date of Patent: Nov. 1, 2005

(54) QUICK CHANGE INFINITELY ADJUSTABLE BARREL NUT ASSEMBLY

(76) Inventor: George Vais, 182 S. Cole Rd., Boise, ID (US) 83709

( * ) Notice: Subject to any disclaimer, the term of this patent is extended or adjusted under 35 U.S.C. 154(b) by 0 days.

(21) Appl. No.: 10/648,888

(22) Filed: Aug. 26, 2003

(65) Prior Publication Data

US 2004/0049964 A1 Mar. 18, 2004

Related U.S. Application Data

(60) Provisional application No. 60/406,260, filed on Aug. 26, 2002.

(51) Int. Cl.[7] ..... F41A 21/00
(52) U.S. Cl. ..... 42/75.02; 42/90
(58) Field of Search ..... 42/75.02, 75.01, 42/90; 89/14.05, 29; 285/333, 390; 403/370, 365, 367, 368, 307, 286

(56) References Cited

U.S. PATENT DOCUMENTS 605,111 A * 6/1898 Mason ..... 42/75.02
3,883,977 A * 5/1975 McClure ..... 42/75.02
4,765,224 A * 8/1988 Morris ..... 89/191.01
5,020,260 A * 6/1991 Houghton ..... 42/75.02
5,272,956 A * 12/1993 Hudson ..... 89/128
5,590,484 A * 1/1997 Mooney et al. ..... 42/111
6,499,245 B1 * 12/2002 Swan ..... 42/71.01
6,792,711 B2 * 9/2004 Battaglia ..... 42/114

* cited by examiner

*Primary Examiner*—M. Clement
(74) *Attorney, Agent, or Firm*—Derek H. Maughan; Dykas, Shaver & Nipper

(57) ABSTRACT

The present invention is a quick change and torque controlled barrel nut assembly for use on a variety of firearms. The invention is made up of a generally cylindrically shaped barrel nut configured to adaptably connect a barrel to a firearm, a gas tube ring that is configured to fit over the barrel nut and a locknut that holds the gas tube ring in place. This invention allows the gun barrel to be rapidly connected by connecting the barrel to the receiver portion of a firearm, placing the freely rotating stabilizing gas ring in a desired position and tightening the locknut to hold the stabilizing gas ring in place.

5 Claims, 4 Drawing Sheets

QUICK CHANGE INFINITELY ADJUSTABLE BARREL NUT ASSEMBLY

PRIORITY

This application claims priority from the provisional application filed Aug. 26, 2002 with Ser. No. 60/406,260 entitled Quick Change Barrel Nut Assembly.

DESCRIPTION

BACKGROUND OF THE INVENTION

1. Field of the Invention

The present invention generally relates to armaments, and more particularly to an assembly for placing and removing barrels on an armament, such placing and removing items such as a barrel from a rifle.

2. Background Information

One of the fixtures of modern warfare is the use of automatic weaponry, particularly rifles such as the AR-15, AR-10, SR-25, A-4, A-2, M-15, A-4 Carbine, A-3, M-16 A-1, M-16 A-4, M-16 Pattern and the like. All of these different types of guns, both automatic and semi-automatic, are basically comprised of a stock connected to a receiver assembly having a handle and a trigger, a bolt carrier assembly, which comprises the firing mechanism, and a barrel. The bolt assembly is usually inserted within or connected to the receiver assembly and leads through an aperture in the receiver assembly to a barrel through which the bullet is projected. The barrels may be rifled to ensure that the flight of the bullet is straight. Many tines the rapid firing of the machine gun causes so many bullets to go through the barrel that the barrel can become hot and deform. In addition, in a combat situation rifle barrels can become jammed, dirty or even bent or broken. Thus the ability to remove and replace barrels from a weapon is a desired and necessary feature.

In most of the aforementioned types of weaponry, the barrel is connected to the receiver assembly by the use of a barrel nut. Most barrel nuts are generally cylindrically shaped devices having a series of inner threads and a series of outer spokes which circumvolve the outer surface of the barrel nut. These spokes define between them a plurality of troughs which are configured to allow passage of a gas tube there through. In use, the upper receiver assembly has a set of inner grooves which are configured to interconnect with complimentarily configured threads of an outer portion of the barrel nut. When attaching the barrel to the upper receiver, the barrel nut is slid along the barrel to a desired position. The barrel is then inserted within the upper receiver assembly, and the barrel nut is tightened to hold the barrel in a desired position. However, in order for the rifle to operate correctly, a gas tube must be inserted into a gas tube vent hole in the upper receiver. In order for this to occur, the gas tube must be placed within one of grooves of the barrel nut.

If the barrel nut is in a tightened position and a trough is not aligned with the gas hole vent tube of the upper receiver to align the grooves between the spokes of the barrel nut, the barrel nut must be torqued to align the barrel nut in a desired position. This often requires a large tool and can result in over-torquing of the barrel nut threads, which can cause damage to the threads, thus causing the connection between the barrel and the upper receiver assembly to be compromised or to function improperly. In addition, torquing or cross threading of the nut and receiver may occur, which will then cause additional damage to both the receiver and the barrel nut and may make their removal nigh unto impossible.

In most connections shown in the existing models of prior art, removing the barrel from the receiver requires a significant amount of time and the use of specialized tools. In order to remove most of the barrels of the prior art, the springs and pins of the front sight must be removed so as to allow the front sight to be adjusted and allow the gas tube to be slid from its position between the spokes of the barrel nut. Once the gas tube has been removed, a tool must be obtained to loosen the barrel nut from its position about the upper receiver assembly and for the barrel to be removed. This can be a troublesome process and, in a pressure situation such as a combat situation, is not desired.

Therefore, what is needed is a device which allows barrels on a variety of forms of weaponry to be rapidly interchanged, adjusted and connected. What is also needed is a torque-controlled means for connecting a barrel to a firearm. What is further needed is a quick change device which allows for rapid changes of the barrel portion of the invention.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a quick change and torque controlled barrel nut assembly for use on a variety of firearms. These types of firearms include, but are not limited to, the AR-15, XM-15, AR-10, SR-25, A-4, A-2, M-15, A-4 Carbine, A-3, M-16 A-1, M-16A-4, SR-25 Pattern and the like. In each of these forms of weaponry, the invention is an improved barrel nut assembly made up of three portions. This invention allows an individual to quickly and easily change a barrel on a firearm in less than one minute and to allow the torque on the barrel to be infinitely adjustable to achieve a desired amount of torque upon the barrel.

The first portion is a barrel nut. The barrel nut is generally cylindrically shaped having a first end extending along a length to a second end. The first end has a series of threaded portions configured within the sleeve at the first end. These threads are configured to adaptably connect to similarly threaded portions on an upper receiver portion of a rifle. The barrel nut has a second end which is adapted to receive the end of a rifle barrel therein.

The barrel nut also has a set of circumvolving grooves circumvolving an outer portion of the barrel nut. These circumvolving grooves are adapted to connect with compatibly configured threaded portions of a locknut. In some applications, the barrel nut may also have a series of holes displaced circumvolvingly around an outer surface of the barrel nut, and an edge displaced within the cylinder. These holes provide a means for tightening the connection between the barrel nut and the upper portion of the rifle. The barrel nut defines a bore extending from the first end through the second end and is adapted to receive a gun barrel therein.

The quick change assembly is also comprised of a gas tube and hand guard support ring. This support ring may be generally cylindrically shaped and is configured to fit over the barrel nut. The gas tube and hand guard support ring have a pair of tabs extending from a first end of the support ring and are configured to be placed on either side of an upper handle of an upper receiver assembly of one of the aforementioned rifles. A groove extends from the first end of the support ring to the second end of the support ring and is adapted to receive a portion of a gas tube therein.

Various adaptations of the support ring may exist in many applications. In some embodiments, portions of the support ring are configured to interconnect with a handle means such as a hand grasp or a forearm. The positioning of the ring about the barrel allows for the gun to be utilized in a floating barrel of floating forearm configuration.

The third part of the nut assembly is a lock nut that locks the support ring in place along the outer surface of the barrel nut. The locknut is generally cylindrical having an inner portion defining a series of grooves that are adapted to configure with the threads on the outer surface of the barrel nut. The locknut can be tightened to compressively engage the support ring against the barrel nut. The locknut, like the barrel nut, has a series of holes therein which are adapted to fit with a spanner wrench, or other tool that can be used to adjustably tighten and release the locknut from the barrel nut assembly. Both the barrel nut and the locknut are configured to have an outer surface configured to be manually grasped and loosened or tightened.

This configuration allows the barrel to be attached and removed by simply twisting the locknut to release the connection between the hand guard support ring and the upper receiver portion of the rifle and then twisting the barrel nut to loosen the connection between the barrel and the main receiver of the assembly. Once this is done, the barrel can be replaced with another barrel having a barrel nut, a support ring and a locknut. This is accomplished by simply inserting the barrel into the upper receiver, tightening the barrel nut, placing the gas tube in a desired position, aligning the gas tube within the designated slot and compressing the locknut against the support ring. This enables barrels to be removed conceivably in less than one minute without the use of tools, which is a tremendous advantage when compared to the barrel nuts used in the prior art.

This device also provides an increased control of the torque and enables for the barrel to be used with or without a tool. In other forms of the invention, a set of holes located at designated locations about the outer surface of the barrel nut and the locknut allow for connection with a specifically designed spanner wrench with a tab configured to fit within these holes. In use, a spanner wrench could be placed upon the locknut or the barrel nut and then be tightened. In some embodiments of the invention, the spanner wrench could be configured so that a bayonet or other tool available to a soldier in the field could be inserted within a portion of the spanner wrench to provide increased leverage on the wrench and increased torque on portions of the barrel nut assembly.

A variety of different adaptable gas rings are also available for different sized handgrips. These adaptably sized gas rings are configured to fit with the existing barrel nut connection. Changing the upper receiver of an assembly can likewise be performed simply by inserting the barrel within the barrel nut, attaching the barrel nut to the upper receiver of the gun assembly, twisting the barrel nut to tighten the connection between the barrel and the upper receiver assembly, aligning the gas ring so that the gas hole passage means (which may be a cylinder, a groove or other aperture defined within the upper guard ring,) is in a desired location whereby the gas tube can fit there through, placing the locknut ring upon the barrel nut and tightening the barrel nut.

Tightening the lock nut holds the gas tube and support ring in place and allows for a variety of differently dimensioned hand guards and forearm grasps to be connected. These also would allow floating forearm type grips to be utilized.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
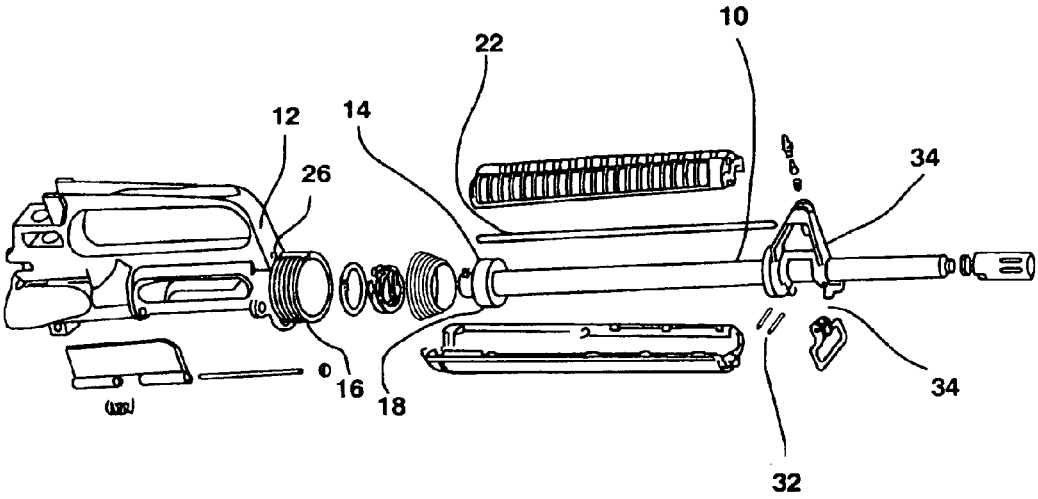
FIG. 1 PRIOR ART
FIG. 1 is a perspective assembly view of a prior art embodiment of a barrel and the upper receiver assemblies of a machine gun with a prior art style barrel nut.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a quick change and torque controlled barrel nut assembly for use on a variety of firearms. These types of firearms include, but are not limited to, the AR-15, XM-15, AR-10, SR-25, A-4, A-2, M-15, A-4 Carbine, A-3, M-16 A-1, M-16A-4, SR-25 Pattern and the like. All of these different types of machine guns are basically comprised of a stock connected to a receiver assembly having a handle and a trigger, a bolt carrier assembly, which comprises the firing mechanism, and a barrel. A detailed perspective view of the barrel and the upper receiving portion is shown in FIG. 1.

Figure 3:
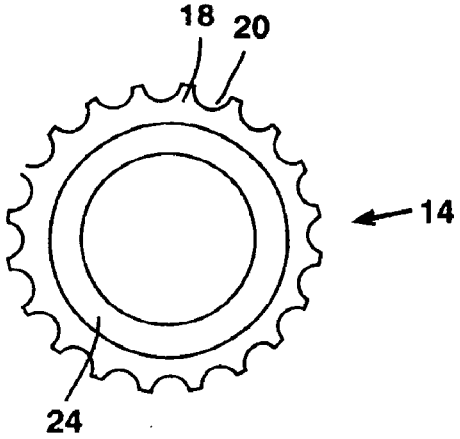
FIG. 3 PRIOR ART
FIG. 3 is a detailed top plan view of a prior art barrel nut.

FIG. 1 shows a barrel 10 connected to the receiver assembly 12 by the use of a barrel nut 14. Most barrel nuts 14 are generally cylindrically shaped devices having a series of inner threads which are configured to attach to a portion of the upper receiver 12. The inner portion of the barrel nut is configured both to receive and hold the barrel as well as to attach to the upper receiver of the firearm. The barrel nut also has a series of outer spokes 18 which circumvolve the outer surface of the barrel nut. These spokes 18 are define between them a plurality of troughs 20 which are configured to allow passage of a gas tube 22 there through. A detailed plan view of a prior art barrel nut is shown in FIG. 3. In this embodiment, the barrel nut 14 is configured to have a series of spokes 18 which define troughs and an inner circumvolving edge 24 which holds the barrel 10 in connection with the barrel nut 14 and the upper receiver 12.

In use, the upper receiver assembly 12 has a set of grooves which are configured to interconnect with complimentarily configured threads of the barrel nut 14. When attaching the barrel 10 to the upper receiver 12, the barrel nut 14 is slid along the barrel 10 to a desired position. The barrel 10 is then inserted within the upper receiver assembly 12 and the barrel nut is tightened to hold the barrel 10 in a desired position. However, in order for the rifle to operate correctly, the gas tube 22 must be inserted into a gas tube vent hole 26 in the upper receiver 12. In order for this to occur, the gas tube 22 must be placed within one of troughs 20 of the barrel nut 10.

While the placement of the gas tube 22 into the troughs 20 prevents the barrel nut from axial rotation about an axis defined by the bore of the barrel 10, it also makes connection and removal of the barrel 10 more difficult. If the barrel nut 10 is in a tightened position and a trough 20 is not aligned with the gas hole vent tube 26 of the upper receiver 12, the barrel nut 14 must be torqued to align the barrel nut 14 into a desired position. This often requires a large tool and can result in over-torquing of the barrel nut threads, which can cause damage to the threads, thus causing the connection between the barrel and the upper receiver assembly to be compromised or to function improperly. In addition, torquing or cross threading of the nut and receiver may occur. This will then cause additional damage to both the receiver and the barrel nut and may make their removal nigh unto impossible.

In most connections of the existing models of prior art, removing of the barrel 10 from a receiver 12 requires a significant amount of time and the use of specialized tools. In order to remove most of the barrels 10 of the prior art, the springs 30 and pins 32 of the front sight 34 must be removed so as to allow the front sight 34 to be adjusted and allow the gas tube 22 to be slid from its position within the trough 20 of the barrel nut. Once the gas tube has been removed, a tool must be obtained to loosen the barrel nut 14 from its position about the upper receiver assembly 12 and for the barrel to be removed. This can be a troublesome process and time-consuming ordeal and in a pressure situation such as a combat situation, is not desired.

Figure 2:
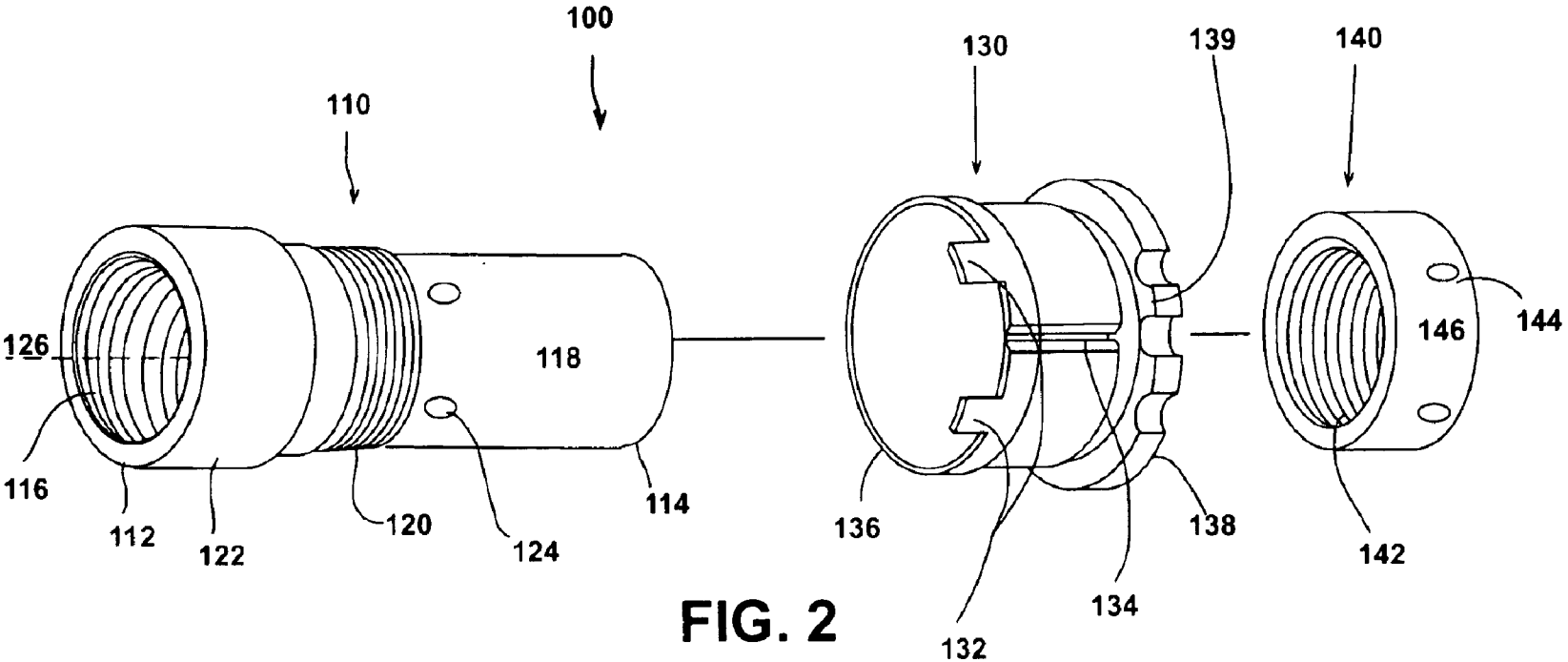
FIG. 2 is a picture of the quick change and torque controlled barrel nut assembly of the present invention.

The present invention is designed to provide an improved barrel nut design which allows the changing of barrels and hand grip portions of a firearm to occur rapidly and easily. A first embodiment of the invention is shown in FIG. 2. The barrel nut assembly 100 is made of three parts. The first portion is a barrel nut 110. The barrel nut 110 is a generally cylindrically shaped sleeve 110 having a first end 112 extending along a length to a second end 114. While in this embodiment certain spatial dimensions and proportions are outlined it is to be distinctly understood that the invention is not limited thereto but may be variously embodied to achieve the outlined results. The first end 112 has a series of threaded portions 116 configured within the sleeve 110 at the first end. These threads 116 are configured to adaptably connect to similarly threaded portions on an upper receiver portion of a rifle. The barrel nut 110 has a second end 114 which is adapted to receive the end of a rifle barrel therein. The barrel nut 110 defines a bore 126 extending along an axis from the first end 112 through the second end 114 and is adapted to receive a gun barrel 10 therein. The barrel nut 110 may in some embodiments also have an internal ledge adapted to hold and maintain the barrel within the barrel nut 110. While in this embodiment the internal ledge is described as the means for maintaining the connection between the barrel and the barrel nut, this means is intended to be illustrative only and not limiting.

The barrel nut also has a set of outer circumvolving grooves 120 circumvolving an outer surface 118 portion of the barrel nut 110. These circumvolving grooves 120 are adapted to connect with compatibly configured threaded portions of a lock nut 140, and to hold a slip-fit type gas ring adapter 130 in a desired tight position against an outer ledge portion 122 of the outer surface 118 of the barrel nut 110.

In order to facilitate the ability of a user to manipulate the barrel nut, in some applications all or a portion of the outer surface 118 of the barrel nut may be configured to facilitate manual grasping. In addition, in some applications, the barrel nut 110 may have a series of holes or other apertures 124 displaced at various locations circumvolvingly around an outer surface of the barrel nut 110. These holes 124 provide a means for tightening the connection between the barrel nut 110 and the upper portion of the rifle 12.

The quick change assembly 100 is also comprised of a slip fit type gas ring adapter 130. This gas ring adapter 130 may have any of a number of shapes but must be configured to fit over the barrel nut 110. The gas ring adapter has a pair of tabs 132 extending from the gas ring adapter 130. These tabs 132 are configured to be placed on either side of an upper handle of an upper receiver assembly 12 of one of the aforementioned rifles. A groove 134 extends from the first end 136 of the support ring to the second end 138 of the gas ring adapter 130 and is adapted to receive a portion of a gas tube 22 therein.

Figure 4:
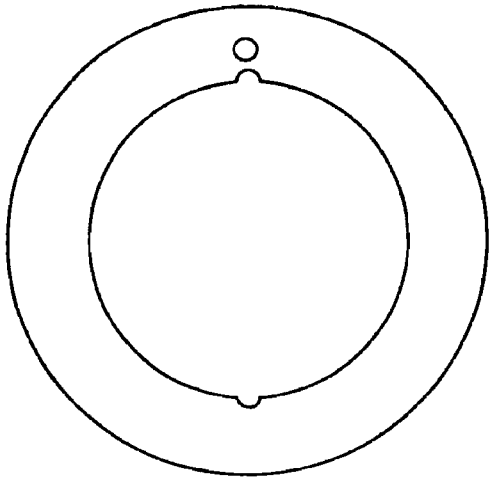
FIG. 4 is a detailed top plan view of a second embodiment of a gas ring.
Figure 6:
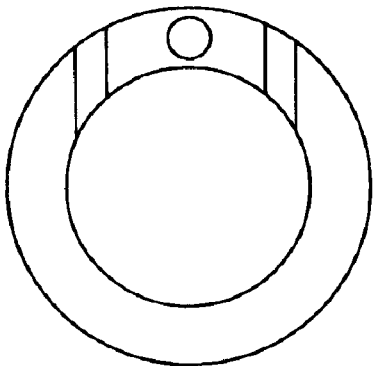
FIG. 6 is a detailed top plan view of a fourth embodiment of a gas ring.
Figure 5:
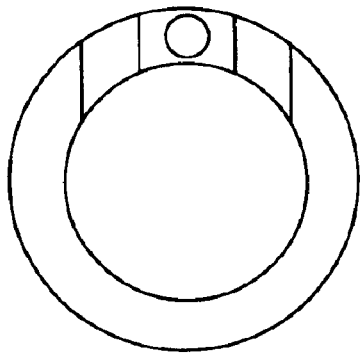
FIG. 5 is a detailed top plan view of a third embodiment of a gas ring.

Various adaptations of the gas ring adapter 130 may exist depending upon the application. In some embodiments, grasp connecting portions 139 of the support ring 130 are configured to interconnect with a grasping means such as hand grasps, hand guards or forearms. The exact dimensions of these grasping portions are dependent upon the type of grasping device that is utilized. Thus, the means for connecting the gas ring adapter 130 to a hand guard may include, but are not limited to, tabs, grooves, threaded portions and other forms of attachment. These types of rings allow for handles and forearms to be utilized together with the barrel of the gun in floating arrangement for improved accuracy. A variety of different shapes and configurations are shown in FIGS. 3, 4 and 6.

Figure 7:
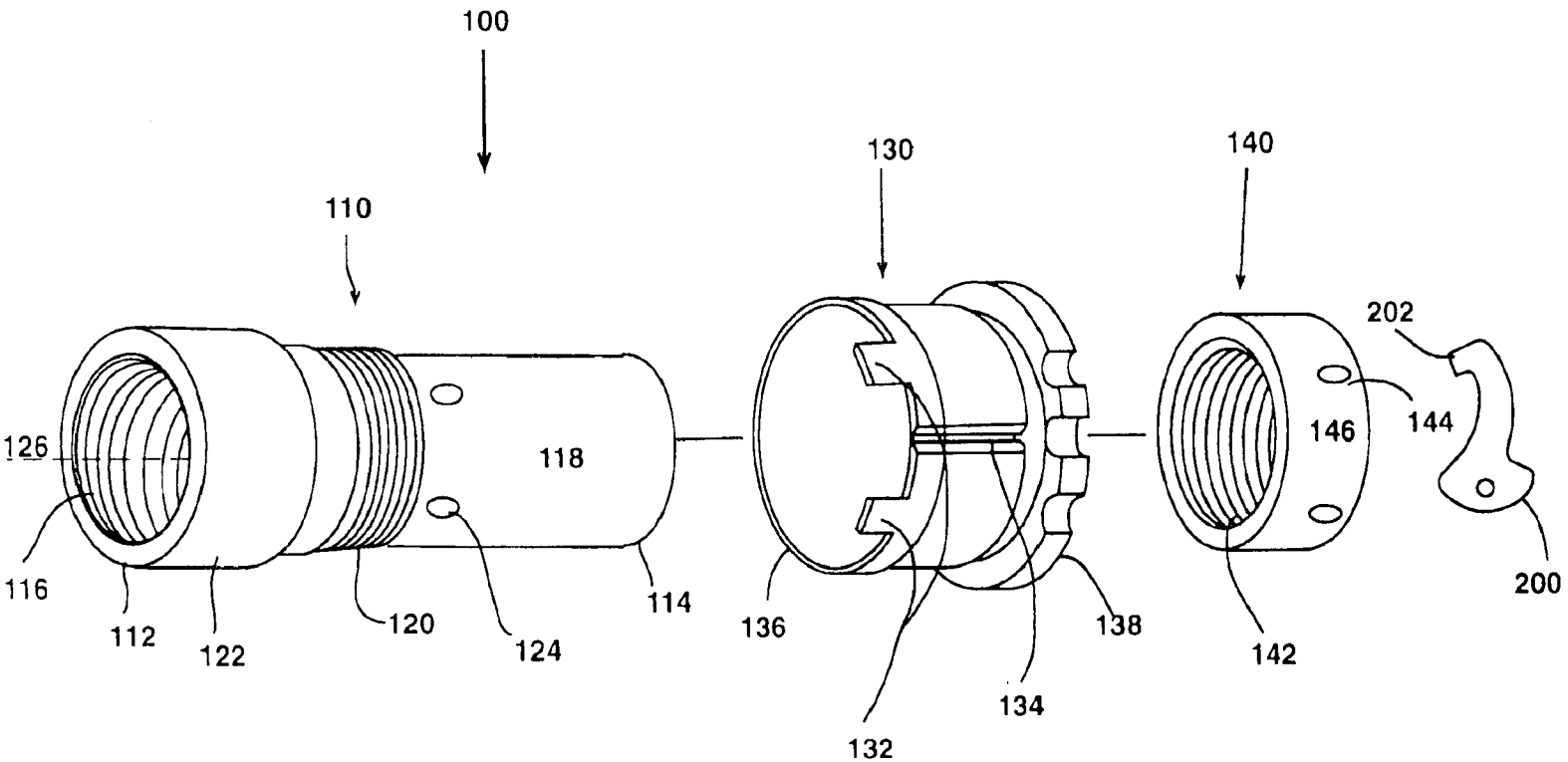
FIG. 7 is a perspective assembly view of the present invention shown with a compatible spanner wrench.

The third part of the nut assembly is a locknut 140 that locks the gas ring adapter 130 in place along the outer surface 118 of the barrel nut 110. The locknut 140 is generally cylindrical having an inner portion 142 defining a series of grooves that are adapted to combine with the threads on the outer surface 120 of the barrel nut 110. The locknut 140 can be tightened to compressively engage the gas ring adapter 130 against the barrel nut 110. The locknut 140, like the barrel nut 110, may have a series of holes 144 therein which are adapted to fit with a spanner wrench, or other tool that can be used to adjustably tighten and release the locknut 140 from the barrel nut assembly. An example of this type of spanner wrench is shown in FIG. 7. This spanner wrench 200 is designed to be small for easy portability while also having portion adapted to connect with an elongated device such as a bayonet or other device, which is commonly carried by a soldier.

Both the barrel nut 110 and the locknut 140 have outer surfaces configured to be manually grasped and manipulated. This configuration allows the barrel 10 to be attached and removed from the upper receiver 12 by simply twisting the locknut 140 to release the connection between the hand guard support ring 130, the barrel nut 110 and the upper receiver portion of the rifle 12. Once this is loosened, the gas tube 22 can be removed and the barrel nut 110 can then be twisted to loosen the connection between the barrel 10 and the main receiver assembly 12. The barrel 10 can then be removed from the upper receiver 12.

A new barrel can be replaced by simply inserting the barrel 10 into the upper receiver 12, tightening the barrel nut 110, placing the gas ring adapter 130 in a desired position, aligning the gas tube 22 within the designated slot 134 of the gas ring adapter 130 and compressing the locknut 140 against the gas ring adapter 130. This enables a variety of barrels 10 to be removed inconceivably less than one minute without the use of tools, which is a tremendous advantage when compared to the barrel nut system used in the prior art.

This device also provides an increased control of the torque and enables for the barrel to be used with or without a tool. In other forms of the invention, a set of holes 124, 144 located at designated locations about the outer surface of the barrel nut and the locknut allow for connection with a specifically designed spanner wrench 200 which has a tab 202 configured to fit within these holes 124, 144. In use and as shown in FIG. 7, a spanner wrench 200 could be placed upon the locknut or the barrel nut and then be tightened. In some embodiments of the invention, the spanner wrench could be configured so that a bayonet or other tool available to a soldier in the field could be inserted within a portion of the spanner wrench to provide increased leverage on the wrench and increased torque on portions of the barrel nut assembly.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. An assembly system for connecting a rifle barrel to an upper receiver portion of a rifle said assembly system comprising three separate pieces:

a first piece, a barrel nut, said barrel nut being a generally cylindrically shaped piece defining a generally longitudinal bore extending from a first end along a longitudinal axis to a second end, said bore having a threaded first portion configured to connect with said upper receiver portion of said rifle, said bore also configured to hold a rifle barrel within said barrel nut, said barrel nut further comprising circumvolving grooves configured to engage a lock nut upon an outer surface of said barrel nut;

a second piece, a gas tube and hand guard support ring configured for non-engaging placement over said barrel nut, said gas tube and band guard support ring having a pair of tabs extending from said support ring, said tabs configured to allow said gas tube and hand guard support ring to align in a desired location upon said upper receiver portion of said rifle; and a third piece, a threaded lock nut configured for connection with said barrel nut, said lock nut configured to compressively engage and hold said support ring in a desired removable position between said threaded lock nut and said upper portion of said rifle.

2. The assembly system of claim 1 wherein said gas tube and hand guard support ring further defines a groove configured to receive a gas tube therein.

3. The assembly system of claim 1 wherein said barrel nut and said lock nut define at least one aperture.

4. The assembly system of claim 3 wherein said at least one aperture is configured to receive a portion of a tightening tool therein.

5. An assembly system for connecting a rifle barrel to an upper receiver portion of a rifle said assembly system comprising three separate pieces:

a first piece, a barrel nut, said barrel nut a generally cylindrically shaped piece having an outer surface and defining a generally longitudinal bore extending from a first end along a longitudinal axis to a second cad, said bore having a threaded first portion configured to connect with said upper receiver portion of said rifle, said bore also configured to hold a rifle barrel within said barrel nut, said outer surface of said barrel nut further comprising a plurality circumvolving grooves, said circumvolving grooves configured to engage a lock nut thereupon;

a second piece, a gas tube and hand guard support ring configured for placement over said barrel nut, said gas tube and hand guard support ring having at least one portion configured to receive and hold a portion of a gas tube therein, a pair of tabs configured to allow said gas tube and hand guard support ring to be held in aligned, non-.engaging placement upon said rifle; and a third piece a threaded lock nut configured for connection with said circumvolving grooves of said barrel nut, said lock nut configured to compressively hold said gas tube and hand guard support ring in a desired removable position upon said barrel nut.

* * * * *